US007861344B2

(12) United States Patent
Jung et al.

(10) Patent No.: US 7,861,344 B2
(45) Date of Patent: Jan. 4, 2011

(54) WASHING MACHINE AND METHOD FOR CONTROLLING THE SAME

(75) Inventors: Jung Ran Jung, Suwon-si (KR); Kyung Chan Woo, Goseong-Koon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 797 days.

(21) Appl. No.: 11/437,801

(22) Filed: May 22, 2006

(65) Prior Publication Data

US 2007/0079448 A1 Apr. 12, 2007

(30) Foreign Application Priority Data

Oct. 6, 2005 (KR) ..... 10-2005-0093980

(51) Int. Cl.
*D06F 35/00* (2006.01)

(52) U.S. Cl. ..... 8/158; 68/12.19; 68/12.21; 68/12.14; 68/12.23

(58) Field of Classification Search ..... 8/158; 68/12.19, 12.21, 12.23
See application file for complete search history.

(56) References Cited

U.S. PATENT DOCUMENTS

| | | | | |
|---|---|---|---|---|
| 4,987,627 | A * | 1/1991 | Cur et al. | 8/158 |
| 5,211,037 | A * | 5/1993 | Adamski et al. | 68/12.16 |
| 5,219,370 | A * | 6/1993 | Farrington et al. | 8/158 |
| 5,293,760 | A * | 3/1994 | Tani et al. | 68/12.02 |
| 2003/0167803 | A1 * | 9/2003 | Wilson et al. | 68/12.24 |
| 2003/0217417 | A1 * | 11/2003 | Jung | 8/158 |
| 2005/0257576 | A1 | 11/2005 | Omura et al. | |

FOREIGN PATENT DOCUMENTS

| | | |
|---|---|---|
| KR | 1996-0031688 | 9/1996 |
| KR | WO2004/106614 | * 12/2004 |
| KR | 10-2005-0040578 | 5/2005 |
| WO | WO 2004/106614 | 12/2004 |
| WO | WO 2004/106615 | 12/2004 |

OTHER PUBLICATIONS

European Search Report for corresponding application No. 06010404.9-2314.
Belfer, F., "An equipment and manufacturing techniques of public services," Moscow, 1984, pp. 34, 35, 44 and 45.
Russian Office Action issued Jun. 27, 2007 in corresponding Korean Patent Application No. 10-2005-0093980.
Japanese Office Action for corresponding Japanese Patent Application 2006-194687; mailed Dec. 2, 2008.
Chinese Office Action for corresponding Chinese application 200610093591.7; issued Oct. 23, 2009.

* cited by examiner

*Primary Examiner*—Frankie L Stinson
*Assistant Examiner*—Jason Heckert
(74) *Attorney, Agent, or Firm*—Staas & Halsey LLP

(57) ABSTRACT

A washing machine which prevents wrinkling of laundry in washing, rinsing, and dehydrating operations, and a method for controlling the same. The method includes determining whether a wrinkle preventing course is selected, performing a washing operation by supplying washing water to a water level designated according to an amount of the laundry disposed in the washing machine, when it is determined that the wrinkle preventing course is selected, and measuring a time of the washing operation, and additionally supplying the washing water at a designated time before the washing of the laundry is completed.

23 Claims, 3 Drawing Sheets

WASHING MACHINE AND METHOD FOR CONTROLLING THE SAME

CROSS-REFERENCE TO RELATED APPLICATIONS

This application claims the benefit of Korean Patent Application No. 10-2005-0093980, filed Oct. 6, 2005, in the Korean Intellectual Property Office, the disclosure of which is incorporated herein by reference.

BACKGROUND OF THE INVENTION

1. Field of the Invention

The present invention relates to a washing machine and a method for controlling the same. More particularly, to a washing machine which prevents wrinkling of laundry from an initial stage of a washing operation and a method for controlling the same.

2. Description of the Related Art

Generally, a conventional washing machine is an apparatus for washing laundry using a force generated by lifting and dropping the laundry placed in a cylindrical rotary drum when the rotary drum is rotated. Since the washing of the laundry is carried out by lifting and dropping the laundry due to the rotation of the rotary drum, the rotary drum is rotated by a motor driven at a predetermined high rpm.

In the above washing machine, the laundry is attached to the rotary drum even after the termination of the washing operation so wrinkling of the laundry occurs from when the washing is started and is accumulated until when final dehydration is completed. Accordingly, the washing machine generates a large amount of wrinkling of the laundry.

In order to solve the above problem, Korean Patent Laid-open Publication No. 1996-0031688 discloses a method for minimizing wrinkling of laundry in a washing machine after dehydration.

The method, disclosed in the above Patent, causes a dehydrating speed to be selected by a user according to types of laundry, and to be changed in stages so as to assure a proper wrinkling degree, thereby performing dehydration corresponding to the wrinkling degree and a desired dehydration degree. This method cannot initially prevent wrinkling of the laundry started from the washing operation and only minimizes the wrinkling of the laundry in the dehydrating operation after washing and rinsing operations, which was generated during the washing and rinsing operations, thus causing the wrinkling of the laundry not to be completely prevented.

SUMMARY OF THE INVENTION

Accordingly, it is an aspect of the present invention to provide a washing machine in which wrinkling of laundry is prevented by controlling a supply of water in a washing operation so as to prevent the wrinkling of the laundry from an initial stage of an operation of the washing machine, and a method for controlling the same.

Additional aspects and/or advantages of the invention will be set forth in part in the description which follows and, in part, will be apparent from the description, or, may be learned by practice of the invention.

IT is another aspect of the present invention to provide a washing machinein which wrinkling of laundry is prevented by controlling an amount of water and a stream of water in washing and rinsing operations so as to efficiently prevent the wrinkling of the laundry, and a method for controlling the same.

It is yet another aspect of the present invention to provide a washing machine in which wrinkling of laundry in a drying operation is prevented in advance by restricting a final dehydrating time within less than a designated value, and a method for controlling the same.

The foregoing and/or other aspects of the present invention are achieved by providing a method for controlling a washing machine including determining whether a wrinkle preventing course is selected, performing a washing operation by supplying washing water up to a water level designated according to an amount of laundry disposed in the washing machine, when it is determined that the wrinkle preventing course is selected; and measuring a time of the washing operation, and additionally supplying the washing water at a designated time before washing of the laundry is completed.

The method further includes performing a washing operation for preventing wrinkling of the laundry, after the additional supply of the washing water.

A motor in the washing operation for preventing wrinkling of the laundry is driven at an operation rate lower than that in the general washing operation.

The amount of the additionally supplied washing water is an amount reaching a water level of approximately 80% higher than the designated water level.

The method further includes performing a rinsing operation for preventing wrinkling of the laundry by supplying rinsing water to a water level higher than a water level designated according to the amount of the laundry in a general rinsing operation, when it is determined that the wrinkle preventing course is selected.

A motor in the rinsing operation for preventing wrinkling of the laundry is driven at an operation rate lower than that in the general rinsing operation.

The amount of the additionally supplied rinsing water may be an amount reaching a water level of approximately 80% higher than the designated water level.

An interim dehydrating operation may be performed at the minimum rpm after the washing and rinsing operations for preventing wrinkling of the laundry are completed such that a partial disposition is not generated.

The method further includes restricting a dehydrating time in the final dehydrating operation, when it is determined that the wrinkle preventing course is selected, and the dehydrating time is less than approximately one minute.

It is another aspect of the present invention to provide a washing machine having a motor and a water supply device, the washing machine including a signal input unit to select a wrinkle preventing course, and a control unit to control the water supply device to prevent wrinkling of laundry, when the wrinkle preventing course is selected.

The control unit performs a washing operation by supplying washing water to a water level designated based upon the amount of laundry disposed in the washing machine; and measures a time of a washing operation and controls the water supply device so that washing water is additionally supplied at a designated time before the washing operation is completed.

The control unit performs a washing operation for preventing wrinkling of the laundry after the additional supply of the washing water.

The control unit performs a rinsing operation by supplying rinsing water to a water level higher than a water level designated by the amount of the laundry in a general rinsing operation.

The control unit adjusts an operation rate of the motor in the washing and rinsing operations for preventing wrinkling of the laundry to be lower than those in the general washing, and rinsing operations.

The control unit controls the motor such that a partial disposition is not generated, after the washing and rinsing operations for preventing wrinkling of the laundry, to perform an interim dehydrating operation.

The control unit restricts a time of the final dehydrating operation.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
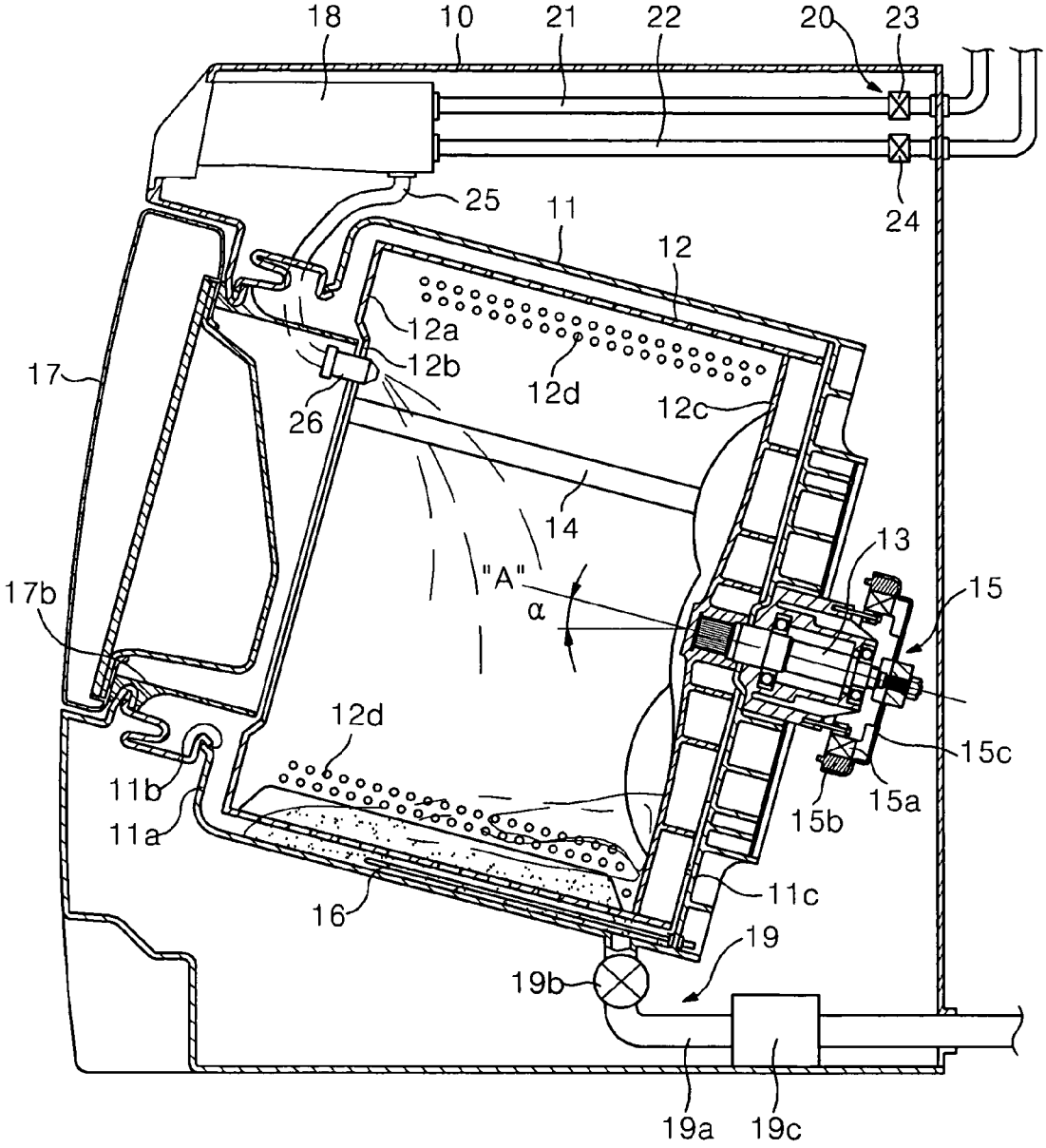
FIG. 1 is a sectional view of a washing machine in accordance with an embodiment of the present invention.

Reference will now be made in detail to the embodiments of the present invention, an example of which is illustrated in the accompanying drawings, wherein like reference numerals refer to like elements throughout. The embodiments are described below to explain the present invention by referring to the figures.

FIG. 1 is a sectional view of a washing machine in accordance with an embodiment of the present invention.

In FIG. 1, the washing machine of the present invention comprises a tub 11 having a cylindrical shape installed in a main body 10 for containing washing water, and a rotary drum 12 rotatably installed in the tub 11.

The tub 11 is slantingly installed at an angle of a designated degree of $\alpha$ with an installation plane of the washing machine such that a front surface portion 11*a* thereof having an opening 11*b* is located at a position higher than that of a rear surface portion 11*c* thereof. In the same manner as the tub 11, the rotary drum 12 is slantingly installed in the tub 11 such that a front surface portion 12*a* thereof having an opening 12*b* is located at a position higher than that of a rear surface portion 12*c* thereof.

That is, a rotary central line of the rotary drum 12 meets the installation plane of the washing machine at an angle of a designated degree of $\alpha$ such that the front surface portion 12*a* having the opening 12*b* faces upward. A rotary shaft 13 connected with a center of the rear surface portion 12*c* of the rotary drum 12 is rotatably supported by the center of the rear surface portion 11*c* of the tub 11, thereby allowing the rotary drum 12 to be rotatable in the tub 11.

A plurality of through holes 12*d* are formed through a circumferential surface of the rotary drum 12, and a plurality of lifters 14 to lift and drop the laundry when the rotary drum 12 is rotated are installed on an inner surface of the rotary drum 12.

A motor 15 serving as a driving device for rotating the rotary shaft 13 connected with the rotary drum 12 to perform washing, rinsing and dehydrating operations is installed on an outer surface of the rear surface portion 11*c* of the tub 11, and a washing heater 16 to heat washing water supplied to an inside of the tub 11 is installed in a lower portion of the tub 11.

The motor 15 comprises a stator 15*a* fixed to the rear surface portion 11*c* of the tub 11, a rotor 15*b* rotatably installed around the stator 15*a*, and a rotating plate 15*c* to connect the rotor 15*b* to the rotary shaft 13.

An opening 17*b* is formed through the front surface of the main body 10 at a position corresponding to the opening 12*b* of the rotary drum 12 and the opening 11*b* of the tub 11 so that laundry is taken into and out of the rotary drum 12 through the opening 17*b*, and a door 17 to open and to close the opening 17*b* is installed at the opening 17*b*.

A detergent supply device 18 to supply a detergent and a water supply device 20 to supply washing water are installed above the tub 11, and a drain device 19 comprising a drain pipe 19*a*, a drain valve 19*b*, and a drain pump 19*c* to discharge water in the tub 11 is installed below the tub 11.

An inside of the detergent supply device 18 is divided into multiple chambers, and the detergent supply device 18 is installed in the front surface of the main body 10 so that a user can easily put the detergent and a fabric softener into the corresponding chambers.

The water supply device 20 comprises cold and warm water supply pipes 21 and 22 to respectively supply cold and warm water, and water supply valves 23 and 24 installed in the cold and warm water supply pipes 21 and 22 to control the supply of the water through the cold and warm water supply pipes 21 and 22.

The cold and warm water supply pipes 21 and 22 are connected with the detergent supply device 18 so that water supplied from an outside is supplied towards the detergent supply device 18. A separate water supply pipe 25 is installed between the detergent supply device 18 and the tub 11 so that the water having passed through the detergent supply device 18 is supplied to the tub 11, and a water supply nozzle 26 is installed at an outlet of the water supply pipe 25. Thereby, the water to be supplied to the tub 11 passes through the detergent supply device 18 to solve the detergent in the detergent supply device 18, and the water containing the detergent is supplied to the tub 11.

Figure 2:
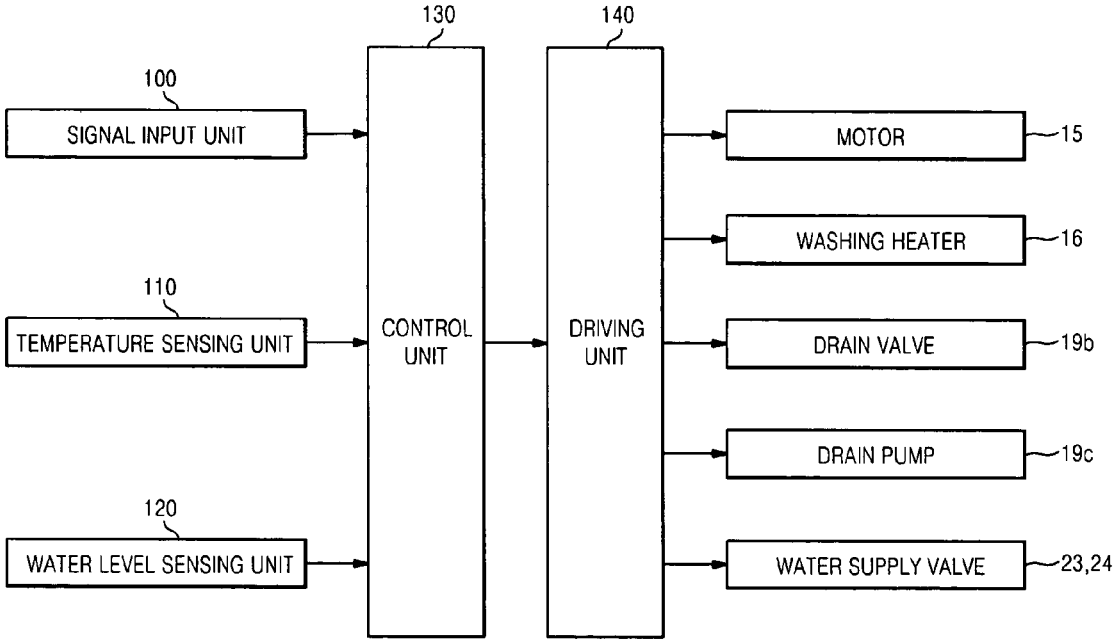
FIG. 2 is a schematic view illustrating a controlling system of the washing machine in accordance with an embodiment of the present invention.

FIG. 2 is a schematic view illustrating a controlling system of the washing machine in accordance with an embodiment of the present invention. The washing machine further comprises a signal input unit 100, a temperature sensing unit 110, a water level sensing unit 120, a control unit 130, and a driving unit 140.

The signal input unit 100 serves to input operating data, such as a washing course, a washing temperature, a dehydrating rpm, and whether or not a rinsing operation is added, which are selected by a user according to materials of the laundry, to the control unit 130. The user selects a wrinkle preventing course for minimizing wrinkling of laundry so that the laundry is easily ironed.

The temperature sensing unit 110 senses the temperature of the washing water supplied to the tub 11, and the water level sensing unit 120 senses the level of the washing water supplied to the tub 11.

The control unit 130 is a microcomputer to control the washing machine according to the operating data inputted from the signal input unit 100. When the wrinkle preventing course is selected, the control unit 130 controls an operation of the water supply device 20 and the motor 15 so that wrinkling of the laundry is prevented from an initial stage of the washing operation by controlling water supply in two steps in the washing operation, and is efficiently prevented by controlling a water amount, a rpm and an operation rate in the washing and rinsing operations.

The control unit 130 comprises a timer (not shown) installed therein for measuring a dehydrating time in a final dehydrating operation. The timer restricts the dehydrating time in the final dehydrating operation within a predetermined time (approximately one minute), thereby preventing in advance wrinkling of the laundry, which will occur in a drying operation.

The driving unit 140 drives the motor 15, the washing heater 16, the drain valve 19*b*, the drain pump 19*c*, and the water supply valves 23 and 24 according to a driving control signal of the control unit 130.

Hereinafter, the function and effects of the above washing machine and a process for controlling the washing machine will be described.

Figure 3:
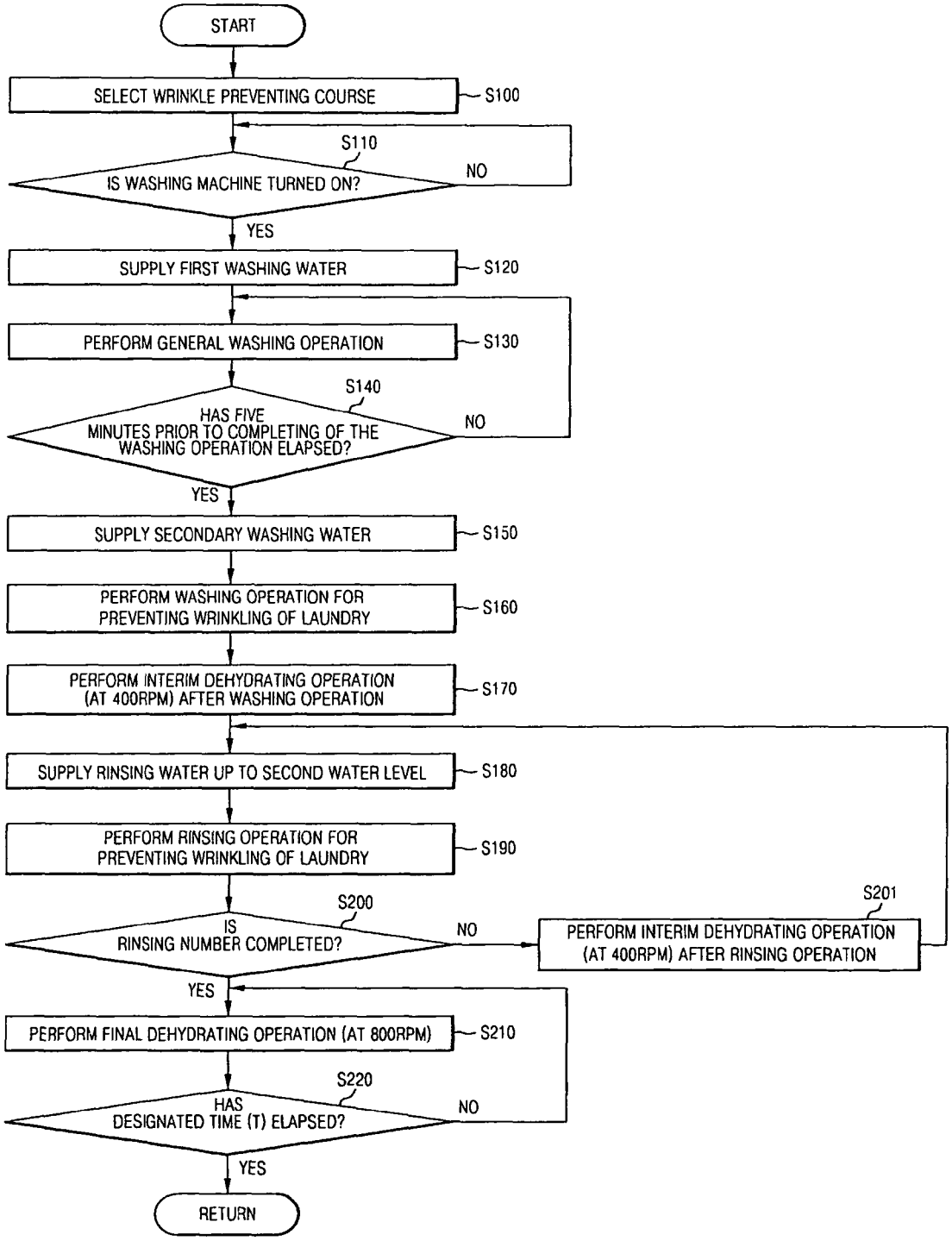
FIG. 3 is a flow chart illustrating a method for controlling a washing machine in accordance with an embodiment of the present invention.

FIG. 3 is a flow chart illustrating a method for controlling the washing machine of the present invention so as to prevent wrinkling of laundry. In the method of the present invention, a wrinkle preventing operation may be set as default such that wrinkling of the laundry is prevented from the washing operation, or as an alternative, the method may be performed only when a user presses a separate option key.

In operation 100, when a user puts laundry into the rotary drum 12, selects operating data, such as a washing course, a washing temperature, a dehydrating rpm, and whether or not a rinsing operation is added, according to materials of the laundry, and then selects a wrinkle preventing course, the operating data, which were selected by the user, are inputted to the control unit 130 through the signal input unit 100.

Then, the control unit 130 performs washing and rinsing operations according to the operating data inputted from the signal input unit 100. First, in operation 110, the control unit 130 determines whether the washing machine is turned on.

When it is determined in operation 110 that the washing machine is turned on, the process moves to operation 120, where the control unit 130 switches the water supply valves 23 and 24 on so that washing water is supplied to the detergent supply device 18 through the water supply pipes 21 and 22, and the washing water supplied to the detergent supply device 18 is supplied to the tub 11 through the water supply pipe 25 up to a first water level based upon the amount of the laundry disposed therein.

When the washing water is supplied to the tub 11 up to the first water level in operation 120, the process moves to operation 130, where the control unit 130 drives the motor 15 at a predetermined rpm and a predetermined operation rate (on/off rate), thereby rotating the rotary drum 12. Thereby, the washing water and the detergent are well mixed with the laundry, and a general washing operation for washing the laundry by falling force of the laundry is performed.

During the washing operation performed in operation 130, the process moves to operation 140, where the control unit 130 measures the time of the washing operation, and determines whether five minutes prior to completing of the washing operation (i.e., a predetermined time according to the amount of the laundry and the operating data selected by the user) has elapsed.

When it is determined in operation 140 that five minutes prior to completing of the washing operation has elapsed, the process moves to operation 150, where the control unit 130 switches the water supply valves 23 and 24 on for preventing wrinkling of the laundry started from the initial stage of the washing operation, thereby allowing the washing water to be supplied to the tub 11 up to a second water level (approximately 80~100% higher than the first water level).

When the washing water is supplied to the tub 11 up to the second water level in operation 150, the process moves to operation 160, where the control unit 130 drives the motor 15 at an operation rate lower than that of the general washing operation, thereby performing a washing operation for preventing wrinkling of the laundry.

The washing operation for preventing wrinkling of the laundry is performed at an operation rate lower than that of the general washing operation, and at the same rpm as that of the general washing operation. Although the rpm in the washing operation for preventing wrinkling of the laundry is the same as that in the general washing operation, since the amount of the washing water in the washing operation for preventing wrinkling of the laundry is approximately 80~100% higher than that in the general washing operation, a mechanical force transmitted to the laundry is lowered. Accordingly, in the washing operation for preventing wrinkling of the laundry, wrinkling of the laundry can be prevented from the initial stage of the operation of the washing machine.

After the washing operation for preventing wrinkling of the laundry, in operation 160 the process moves to operation 170, where the control unit 130 performs an interim dehydrating operation at the minimum rpm (approximately 400 rpm) so that a partial disposition is not generated after draining. Here, since the dehydrating rpm after the washing operation for preventing wrinkling of the laundry is lower than that (i.e., approximately 600 rpm) after the general washing operation, it is possible to minimize wrinkling of the laundry even in the interim dehydrating operation after the washing operation.

When the washing operation is completed, the process moves to operation 180, where the control unit 130 supplies rinsing water to the tub 11 up to the second water level to perform a rinsing operation.

When the rinsing water is supplied to the tub 11 up to the second water level in operation 180, the process moves to operation 190, where the control unit 130 drives the motor 15 at the same rpm and operation rate as those in the washing operating for preventing wrinkling of the laundry, thereby performing a rinsing operation for preventing wrinkling of the laundry.

In the same manner as that of the washing operation for preventing wrinkling of the laundry, since the amount of the rinsing water in the rinsing operation for preventing wrinkling of the laundry is approximately 80~100% higher than that a the general rinsing operation, the mechanical force transmitted to the laundry is lowered. Accordingly, in the rinsing operation for preventing wrinkling of the laundry, wrinkling of the laundry can be minimized.

After the rinsing operation, in operation 200, the control unit 130 determines whether a rinsing number determined based upon the amount of the laundry or the operating data selected by the user is completed. When it is determined in operation 200 that the rinsing number is not completed, the process moves to operation 201, where the control unit 130 performs an interim dehydrating operation at the minimum rpm (approximately 400 rpm) so that a partial disposition is not generated after draining. Here, since the dehydrating rpm after the rinsing operation for preventing wrinkling of the laundry is lower than that (i.e., 800 rpm) after the general rinsing operation, it is possible to minimize wrinkling of the laundry even in the interim dehydrating operation after the rinsing operation.

When it is determined that the rinsing number is completed in operation 200, the process moves to operation 210, where the control unit 130 performs the final dehydrating operation at 800 rpm. Then, from operation 210, the process moves to operation 220, where the control unit 130 measures the time of the final dehydrating operation, and determines whether a designated time T from the start of the final dehydrating operation (i.e., a time to dehydrate the minimum amount of the laundry for preventing wrinkling of the laundry) has elapsed.

When it is determined in operation 220 that the designated time T has elapsed, the control unit 130 completes the final dehydrating operation, and returns the method to the next operation (for example, a drying operation).

As apparent from the above description, the present invention provides a washing machine, which prevents wrinkling of laundry from an initial stage of an operation by controlling supply of water in a washing operation, and efficiently prevents the wrinkling of the laundry by controlling an amount of water and a stream of water in a washing and rinsing operation, and a method for controlling the same.

Further, the washing machine of the present invention restricts a final dehydrating time within a designated time, thereby preventing wrinkling of laundry, which will be generated in a drying operation, in advance.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for controlling a washing machine comprising:

determining whether a wrinkle preventing course is selected;

performing a general washing operation for a first amount of time, by supplying washing water up to a water level designated according to an amount of laundry and driving a motor at a first operation rate so as to wash the laundry; and performing the wrinkle preventing course for a second amount of time when the general washing operation is completed by additionally supplying washing water before a rinsing operation is started and then driving the motor at a second operation rate lower than the first operation rate by adjusting an on/off of the motor so as to prevent wrinkling of the laundry.

2. The method as set forth in claim 1, wherein the amount of the additionally supplied washing water is an amount reaching a water level of approximately 80% higher than the designated water level.

3. The method as set forth in claim 1, wherein an interim dehydrating operation is performed at a minimum rpm after the wrinkle preventing course, such that a partial disposition is not generated.

4. The method as set forth in claim 1, further comprising performing the rinsing operation for preventing wrinkling of the laundry by supplying rinsing water to a water level higher than a water level designated according to the amount of the laundry in a general rinsing operation, when it is determined that the wrinkle preventing course is selected.

5. The method as set forth in claim 4, wherein a motor in the rinsing operation for preventing wrinkling of the laundry is driven at an operation rate lower than that in the general rinsing operation.

6. The method as set forth in claim 4, wherein the amount of the additionally supplied rinsing water is an amount reaching a water level of approximately 80% higher than the designated water level.

7. The method as set forth in claim 4, wherein an interim dehydrating operation is performed at the minimum rpm such that a partial disposition is not generated after the rinsing operation for preventing wrinkling of the laundry.

8. The method as set forth in claim 1, further comprising restricting a dehydrating time in the final dehydrating operation, when it is determined that the wrinkle preventing course is selected.

9. The method as set forth in claim 8, wherein the dehydrating time is less than approximately one minute.

10. A method for controlling a washing machine, comprising:

determining whether or not a wrinkle preventing course is selected;

performing a general washing operation for a first amount of time, by supplying washing water into the washing machine up to a first water level and driving a motor to wash laundry at a first operation rate so as to wash laundry;

finishing the general washing operation after the first amount of time has elapsed and performing the wrinkle preventing course for a second amount of time before a rinsing operation is started; and performing a wrinkle preventing washing operation upon starting of the wrinkle preventing course by supplying wrinkle preventing washing water to a second water level higher than the first water level and then driving the motor at a second operation rate lower than the first operation rate by adjusting an on/off rate of the motor.

11. The method of claim 10, further comprising:

performing an interim dehydration operation after the wrinkle preventing washing operation;

supplying rinsing water to the washing machine;

performing the rinsing operation for preventing wrinkling of the laundry;

determining whether a rinsing operation has been completed a predetermined number of times; and performing a final dehydrating operation when the rinsing operation has been completed the predetermined number of times.

12. The method of claim 11, wherein the interim dehydration operation is performed at a performance rate of approximately 400 rpm.

13. The method of the claim 11, wherein the final dehydration operation is performed at a performance rate of approximately 800 rpm.

14. A method for controlling a washing machine, comprising:

determining whether or not a wrinkle preventing course is selected;

performing a general washing operation by supplying washing water up to a water level designated according to an amount of laundry and driving a motor at a first operation rate so as to wash the laundry;

finishing, upon selection of the wrinkle preventing course, the general washing operation at a designated time prior to a time of completion of the washing operation of the laundry by measuring time of the washing operation, and then starting the wrinkle preventing course to prevent wrinkling of the laundry by driving the motor at a second operation rate lower than the first operation rate by adjusting an on/off rate of the motor before a rinsing operation is started; and supplying wrinkle preventing washing water to a second water level higher than the first water level when the wrinkle preventing course is started.

15. The method of claim 14, further comprising performing a washing operation to prevent wrinkling of the laundry, after the supply of the wrinkle preventing washing water.

16. The method of claim 15, wherein an interim dehydrating operation is performed at a minimum rpm after the wrinkle preventing washing operation, such that a partial disposition is not generated.

17. The method of claim 14, further comprising performing the rinsing operation to prevent wrinkling of the laundry by supplying rinsing water to a water level higher than a water level designated according to the amount of laundry in a general rinsing operation, when it is determined that the wrinkle preventing course is selected.

18. The method of claim 17, wherein a motor is driven in the wrinkle preventing rinsing operation at an operation rate lower than an operation rate in the general rinsing operation.

19. The method of claim 17, wherein an interim dehydrating operation is performed at a minimum rpm such that a partial disposition is not generated after the wrinkle preventing rinsing operation.

20. The method of claim 14, further comprising restricting a dehydrating time in the final dehydrating operation, when it is determined that the wrinkle preventing course is selected.

21. A method of controlling a washing machine, comprising:

performing a general washing operation by supplying washing water into the washing machine and driving a motor at a first operation rate so as to wash laundry;

finishing the general washing operation at a designated time prior to a time of completion of the washing operation of the laundry and starting a wrinkle preventing course before a rinsing operation is started; and performing the wrinkle preventing operation when the wrinkle preventing course is started by supplying wrinkle preventing washing water and driving the motor at a second operation rate lower than the first operation rate by adjusting an on/off rate of the motor.

22. The method of claim 11, further comprising:

performing an interim dehydrating operation after the wrinkle preventing washing operation;

supplying rinsing water to the washing machine;

performing the rinsing operation to prevent wrinkling of the laundry;

determining whether the rinsing operation has been completed a predetermined number of times; and performing a final dehydrating operation when the rinsing operation has been completed the predetermined number of times.

23. The method of claim 21, wherein a processing time of the wrinkle preventing washing operation is shorter than a processing time of the general washing operation.

* * * * *